US005803312A

United States Patent [19]

Credle, Jr. et al.

[11] Patent Number: 5,803,312

[45] **Date of Patent: *Sep. 8, 1998**

[54] MANUALLY OPERABLE POSTMIX JUICE DISPENSER AND DISPOSABLE CONCENTRATE PACKAGE THEREFOR

[75] Inventors: William S. Credle, Jr., Stone Mountain, Ga.; Stephen A. Chreno, Gurney; Robert L. Braido, Barrington, both of Ill.

[73] Assignee: The Coca-Cola Company, Atlanta, Ga.

[ * ] Notice: The term of this patent shall not extend beyond the expiration date of Pat. No. 5,524,791.

[21] Appl. No.: 661,283

[22] Filed: Jun. 10, 1996

Related U.S. Application Data

[63] Continuation-in-part of Ser. No. 257,756, Jun. 8, 1994, Pat. No. 5,524,791.

[51] Int. Cl.[6] ..... B67D 5/56

[52] U.S. Cl. ..... 222/129.1; 222/137; 222/214; 222/325

[58] Field of Search ..... 222/95, 129.1–129.4, 222/137, 145.5, 214, 325, 385, 105

[56] References Cited

U.S. PATENT DOCUMENTS

| | | | |
|---|---|---|---|
| D. 268,840 | 5/1983 | Reed . | |
| D. 317,695 | 6/1991 | Stern . | |
| 1,553,994 | 9/1925 | Estes | 222/129.1 |
| 1,626,544 | 4/1927 | Lorant . | |
| 1,934,623 | 11/1933 | Frick . | |
| 2,685,985 | 8/1954 | Howell, Jr. . | |
| 2,746,642 | 5/1956 | Parks . | |
| 2,859,899 | 11/1958 | Kramer et al. | 222/95 |
| 3,207,376 | 9/1965 | Molitor . | |
| 4,363,426 | 12/1982 | Heinzl et al. . | |
| 4,515,294 | 5/1985 | Udall . | |
| 4,753,370 | 6/1988 | Rudick | 222/105 |
| 4,793,518 | 12/1988 | Burton . | |
| 4,875,604 | 10/1989 | Czech . | |
| 4,982,877 | 1/1991 | Burton . | |
| 5,114,047 | 5/1992 | Baron et al. . | |
| 5,165,577 | 11/1992 | Ophardt . | |
| 5,275,309 | 1/1994 | Baron et al. . | |
| 5,282,552 | 2/1994 | Ophardt . | |
| 5,282,561 | 2/1994 | Mihalich . | |
| 5,353,963 | 10/1994 | Gorski et al. | 222/129.1 |
| 5,524,791 | 6/1996 | Credle et al. | 222/129.1 |

FOREIGN PATENT DOCUMENTS

| | | |
|---|---|---|
| 0339110 | 11/1989 | European Pat. Off. . |
| 0448394A2 | 3/1991 | European Pat. Off. . |

OTHER PUBLICATIONS

Expresso Machine, Domus, Apr. 1977 (D. 7/309) p. 725.

*Primary Examiner*—Gregory L. Huson
*Attorney, Agent, or Firm*—Dennis W. Braswell

[57] ABSTRACT

A low cost, manually operated, postmix juice dispenser for use with a disposable concentrate package includes a water tank manually filled with water and ice, a water pump and a manually operated pump handle. The disposable concentrate package is preferably a flexible pouch with a built-in concentrate pump that connects to the pump handle.

29 Claims, 19 Drawing Sheets

MANUALLY OPERABLE POSTMIX JUICE DISPENSER AND DISPOSABLE CONCENTRATE PACKAGE THEREFOR

CROSS-REFERENCE TO RELATED APPLICATION

This is a continuation-in-part to U.S. patent application Ser. No. 08/257,756 filed Jun. 8, 1994, now U.S. Pat. No. 5,524,791, and having the same assignee as this application.

BACKGROUND OF THE INVENTION

This invention relates to postmix beverage dispensing and in a preferred embodiment to a low cost, manually pumped juice dispenser and to a disposable concentrate package therefor.

Postmix beverage dispensers, wherein a concentrate, such as orange juice, apple juice, etc. is mixed with cooled water are well-known. Such dispensers include electrically operated vapor/compression refrigeration, a built-in concentrate pump, water metering means, and ratio control means. Using such dispensers only requires a cup to be placed below the dispensing faucet or nozzle and pushing a button. Such dispensers, however, are relatively expensive and are thus not a viable option for a low volume account.

SUMMARY OF THE INVENTION

A low cost, manually operated, postmix beverage dispenser including a water tank manually filled with ice and water, a removable concentrate container, and a water pump and a concentrate pump connected to a manually operated pump handle. The pumps are positive displacement pumps having a volumetric ratio equal to the mixture ratio of the water and concentrate. A beverage is dispensed by holding a cup beneath the nozzle, and pumping a pump handle up and down to dispense beverage into the cup. When the water level is low, a lid is removed and water is added to the water tank (along with ice if necessary). When the concentrate container is empty, or it is desired to change flavors, an access door is opened and the concentrate container is replaced with another.

The dispenser can be upgraded with vapor/compression refrigeration, a plumbed water tank, an electric motor to drive the pumps or a water powered motor. The concentrate pump can be built-in to the concentrate package or can be separate.

In a preferred application, the dispenser is used to dispense juices; however, it can also be used with other beverages including tea, coffee, sport drinks and even carbonated drinks.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
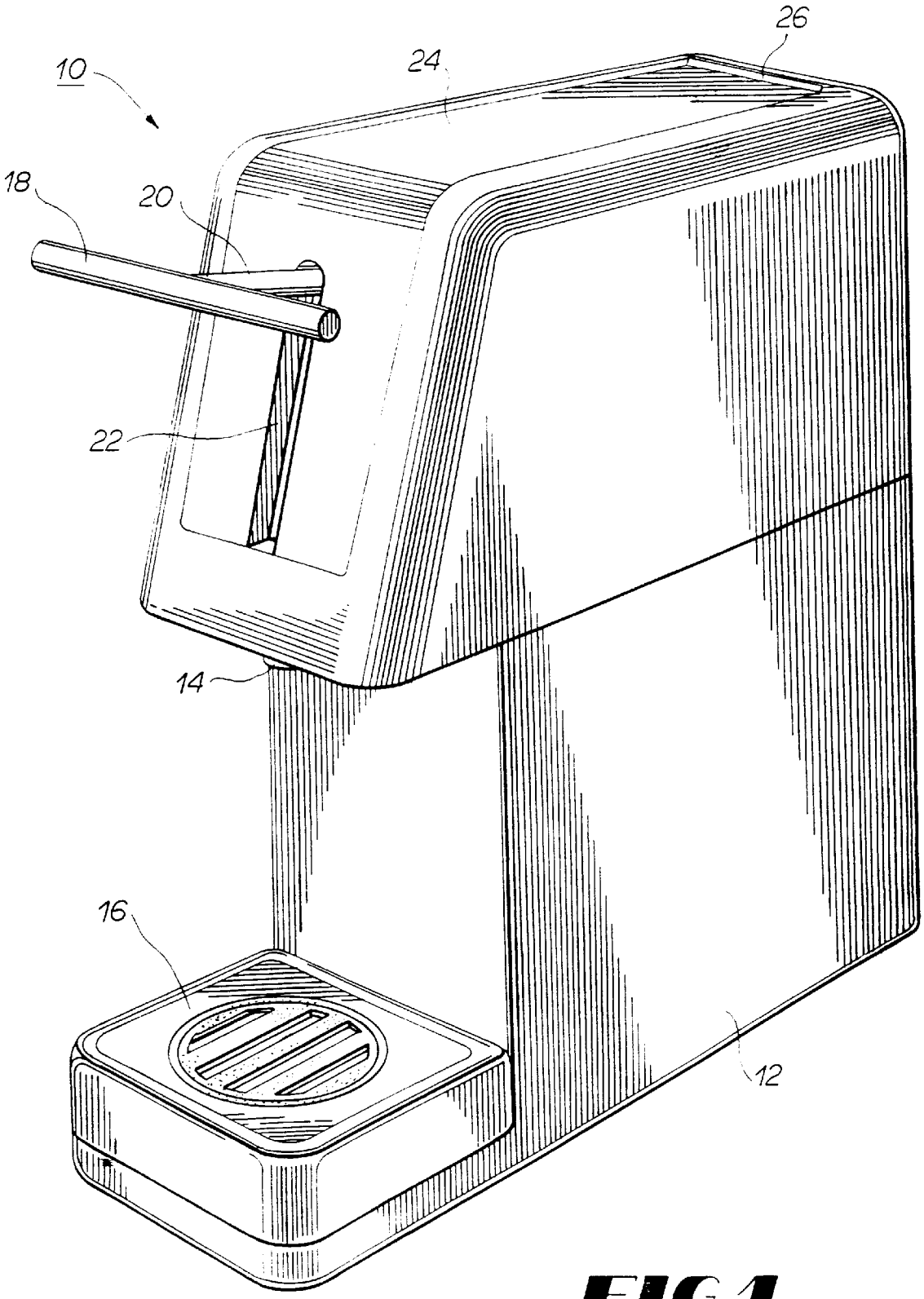
FIG. 1 is a perspective view of a dispenser according to one embodiment of the present invention.
Figure 2:
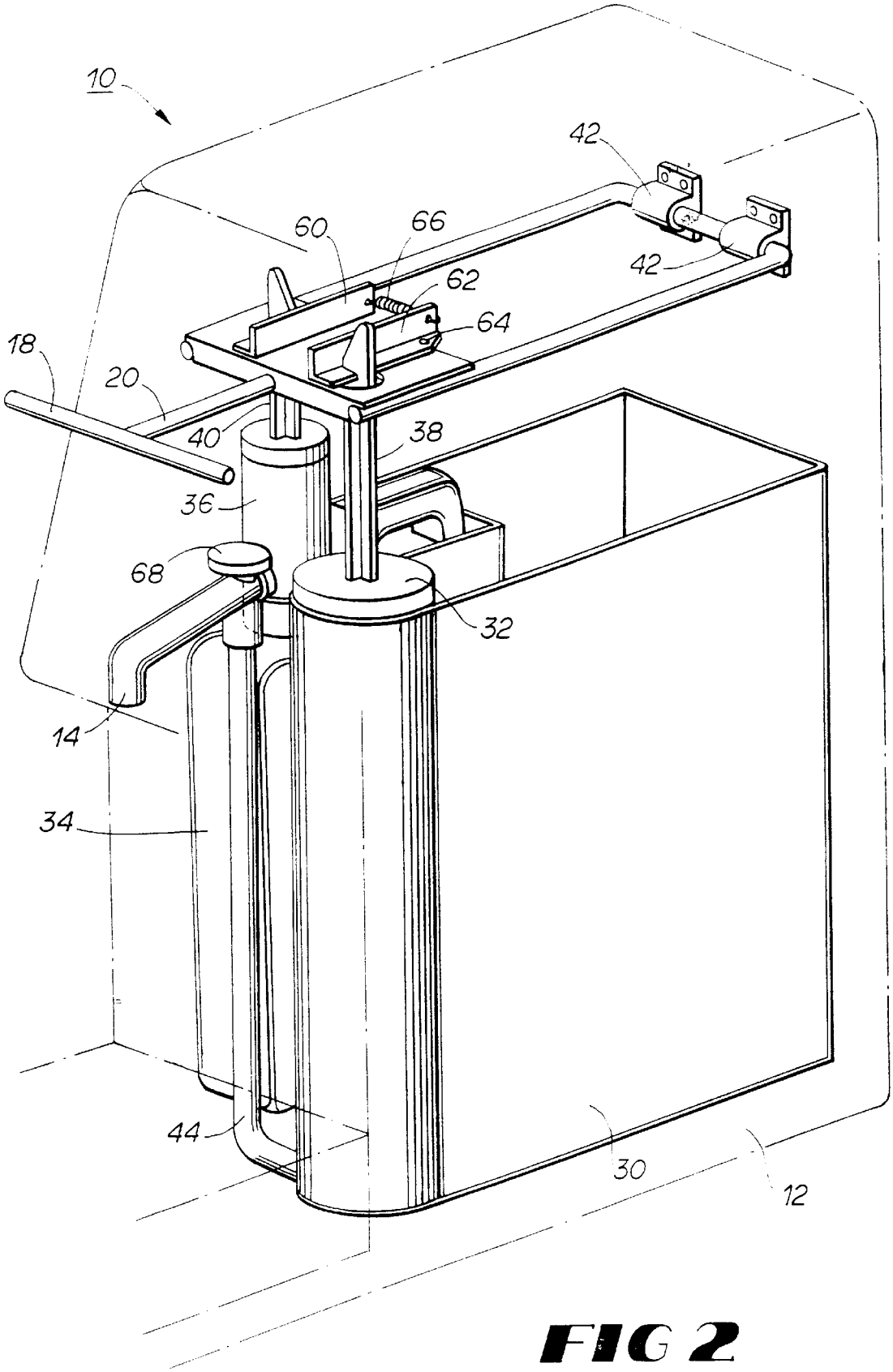
FIG. 2 is a perspective view of the inside of the dispenser of FIG. 1.

With reference now to the drawings, FIGS. 1–5 show a dispenser 10 according to one embodiment of this invention. The dispenser 10 includes a housing 12 having a nozzle 14, a cup rest 16, a pump handle 18 connected to a pump arm 20 extending through an opening 22 in the housing, and a housing access door 24 on a hinge 26.

Inside the dispenser are a water tank 30, a water pump 32, a concentrate package 34 with a dip tube 35, a concentrate pump 36, a water pump piston rod 38, and a concentrate pump piston rod 40. The pump arm is hingedly connected at 42 to the housing. Water is pumped through line 44 to the nozzle 14. The pumps are one-way piston pumps each with a pair of check valves. The concentrate pump 36 includes a pair of flexible arms 46 and 48 which are moved outwardly when fingers 50 and 52 are squeezed. When released, the arms return and shoulders 54 and 56 snap into a groove on the spout of the package to hold the pump to the package.

To dispense a beverage, a cup is placed below the nozzle and the handle 18 is moved up and down as needed to dispense the amount of beverage desired. If the water is low in the tank, or not cool enough, the door 24 is lifted up and ice and water are fed into the tank 30. When the concentrate container is empty, the door 24 is lifted, the pump 36 is removed (the water line 44 need not be disconnected) and a new container 34 is positioned in the housing, hooked to the pump and the door closed.

The pump arm preferably has a pair of spring biased lever arms 60 and 62 that are squeezed toward each other to release the arm 20 from the pumps (from the pump piston rods 38 and 40) but that automatically re-engage when the arm 20 is pushed down, because of the chamfered top end of the rods 38 and 40. The lever arms fit into slots in the rods 38 and 40. The lever arm 62 is pivoted at 64 (arm 60 is similarly pivoted) and the two arms are biased into contact with the piston rods 38 and 40 by a spring 66.

Figure 3:
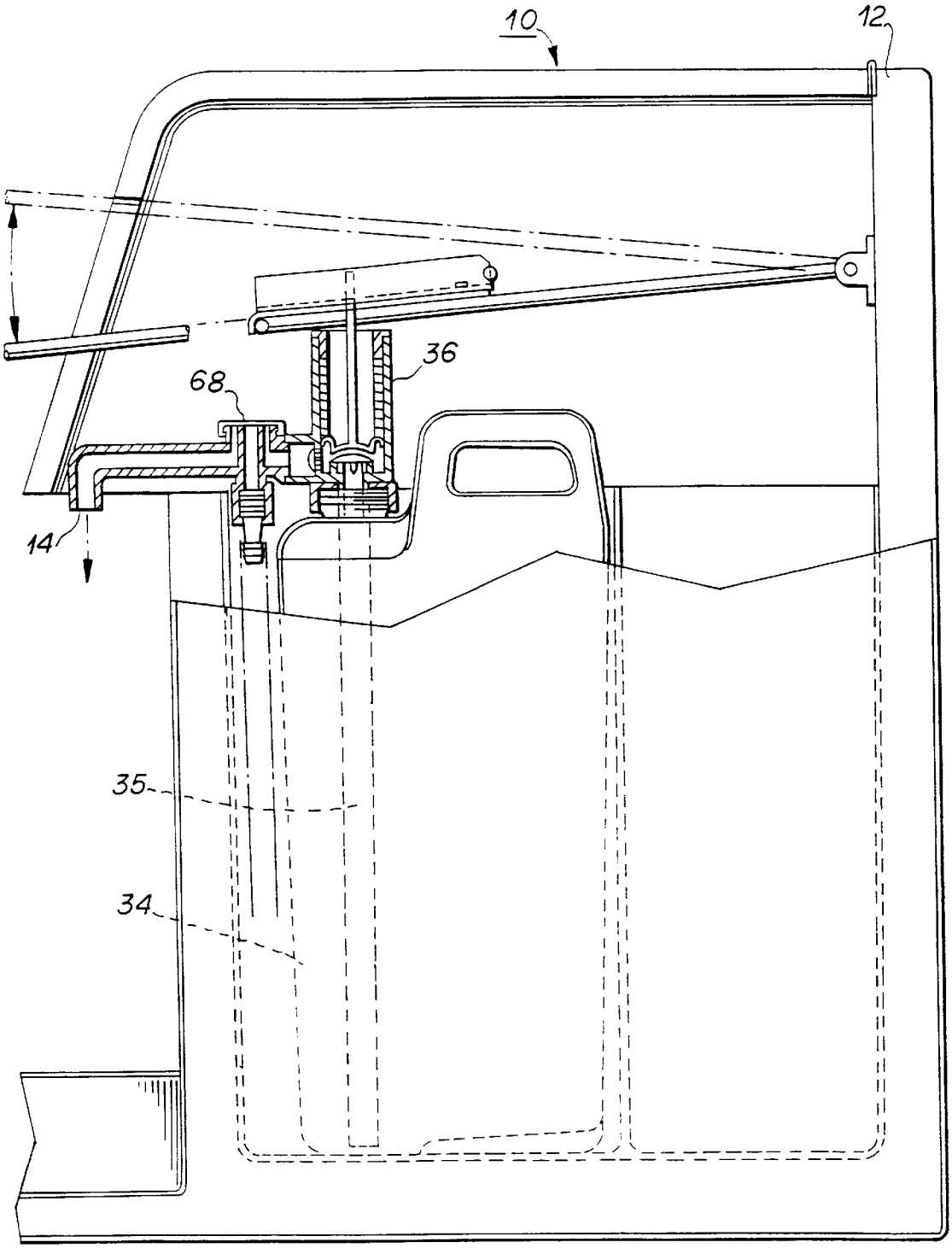
FIG. 3 is a cross-sectional side view through the dispenser of FIG. 1 taken along line 3—3 of FIG. 2.
Figure 4:
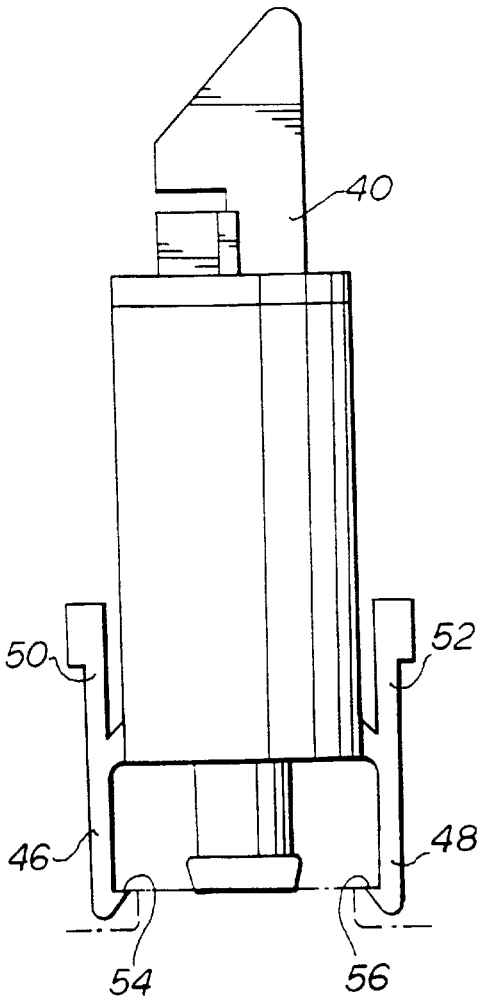
FIG. 4 is a rear view of the concentrate pump of FIG. 3.

The water line 44 connects to the nozzle as shown in FIG. 3. It is normally closed by an elastomeric check valve or cap 68 that is forced up to open when water is pumped up through line 44.

Figure 5:
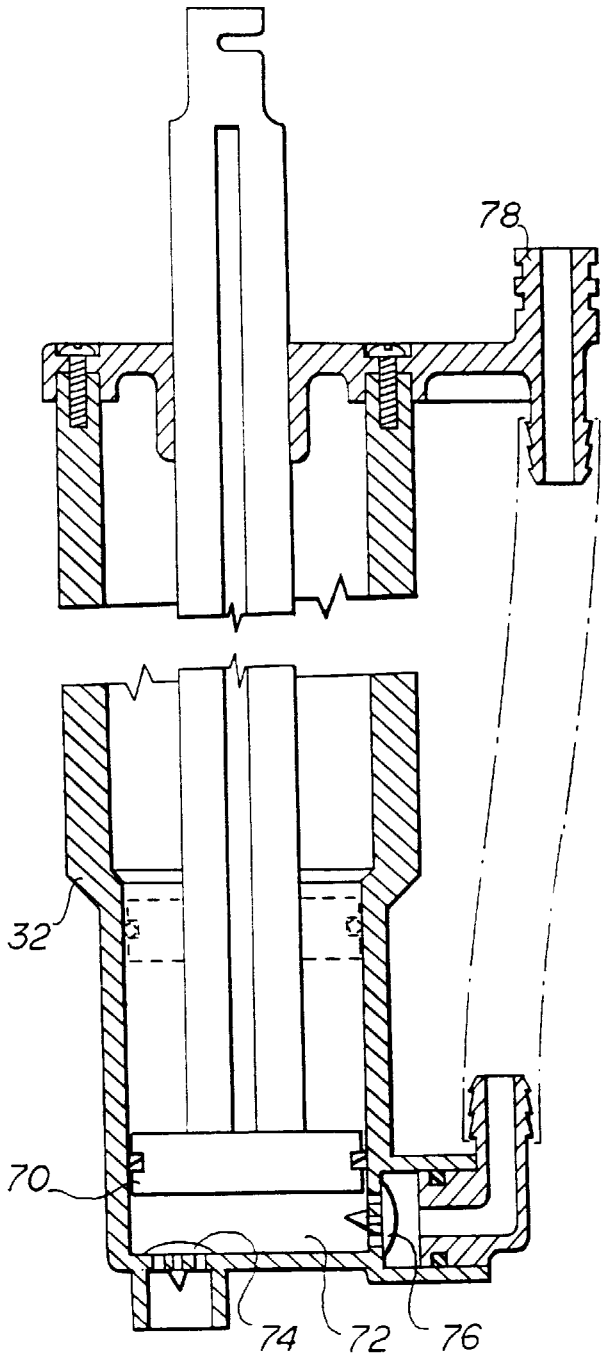
FIG. 5 is a cross-sectional side view through the water pump of FIG. 2 taken along line 5—5 of FIG. 2.

FIG. 5 shows the water pump 32 with a piston 70 connected to the piston rod 38, a pumping chamber 72, an inlet check valve 74, an outlet check valve 76, the water line 44, and a fitting 78 for connecting to the nozzle.

Figure 6:
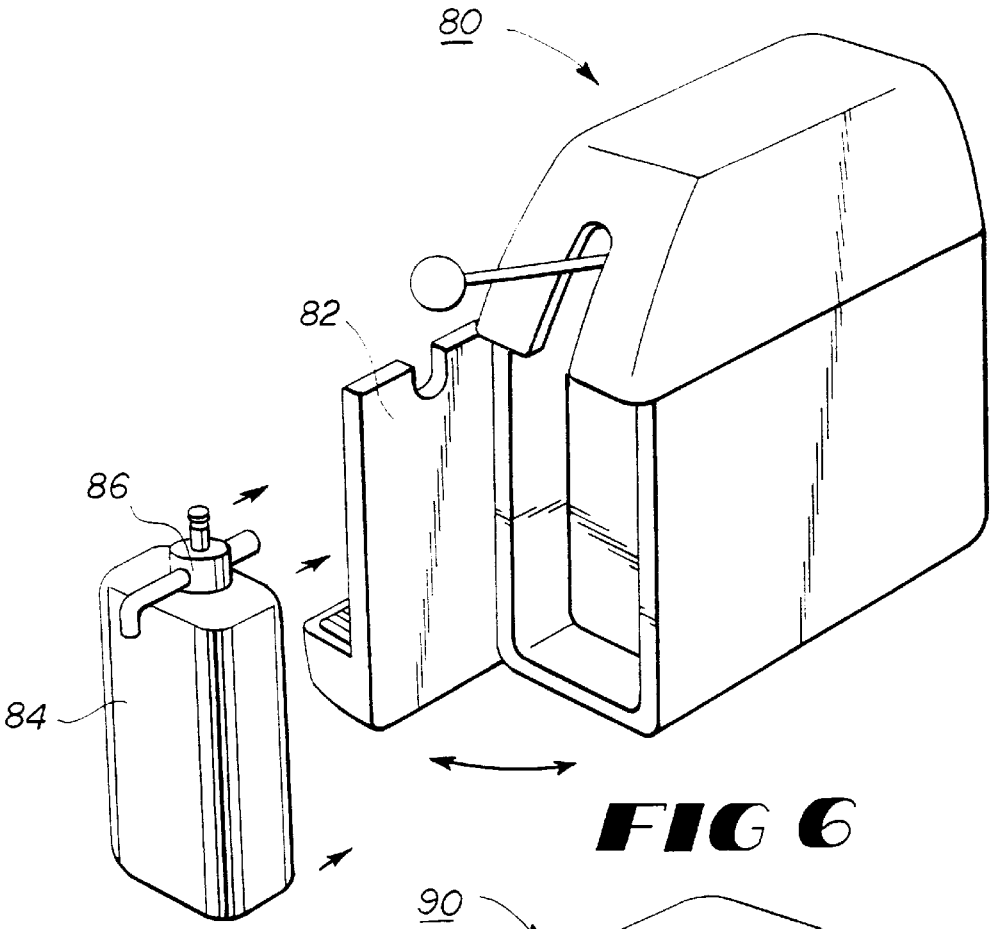
FIG. 6 is a perspective view of a dispenser according to another embodiment of this invention.

FIG. 6 shows a dispenser 80 according to another embodiment of this invention having a front opening door 82 for a concentrate container 84 having a built-in pump 86. The water pump can also slide out the front for cleaning and/or replacement. In all embodiments, the top of the dispenser is preferably a cover that is removable for allowing the water tank to be lifted up and out for cleaning.

Figure 7:
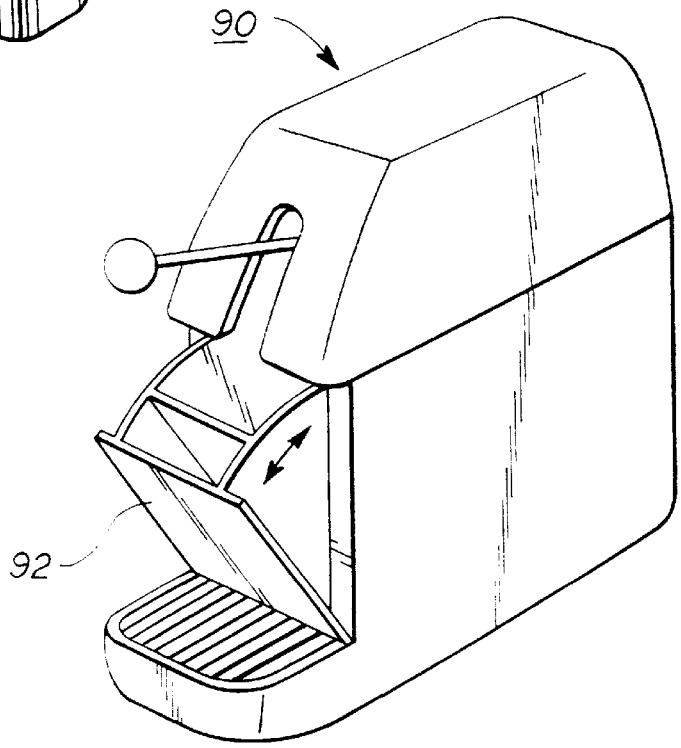
FIG. 7 is a perspective view of yet another embodiment of a dispenser of this invention.

FIG. 7 shows still another embodiment of a dispenser 90 having a front door 92 that pivots out to receive a concentrate container.

Figure 8:
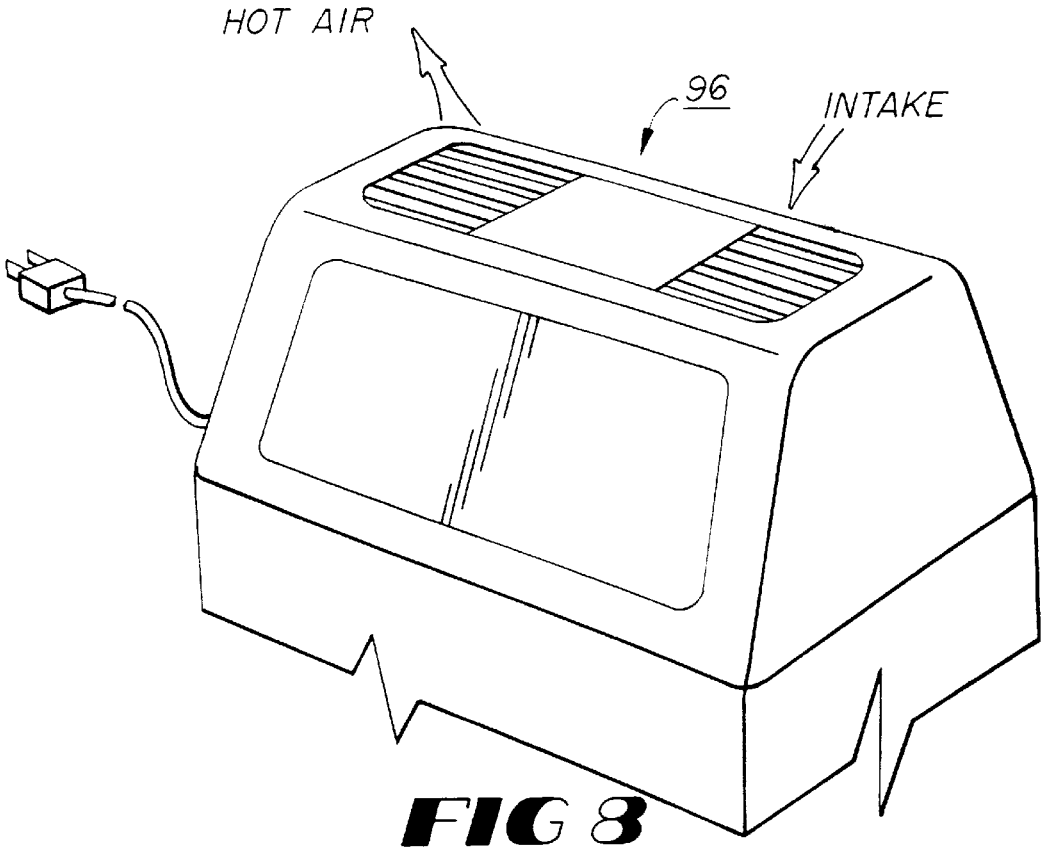
FIG. 8 is a perspective view of a cover of another embodiment of this invention.
Figure 9:
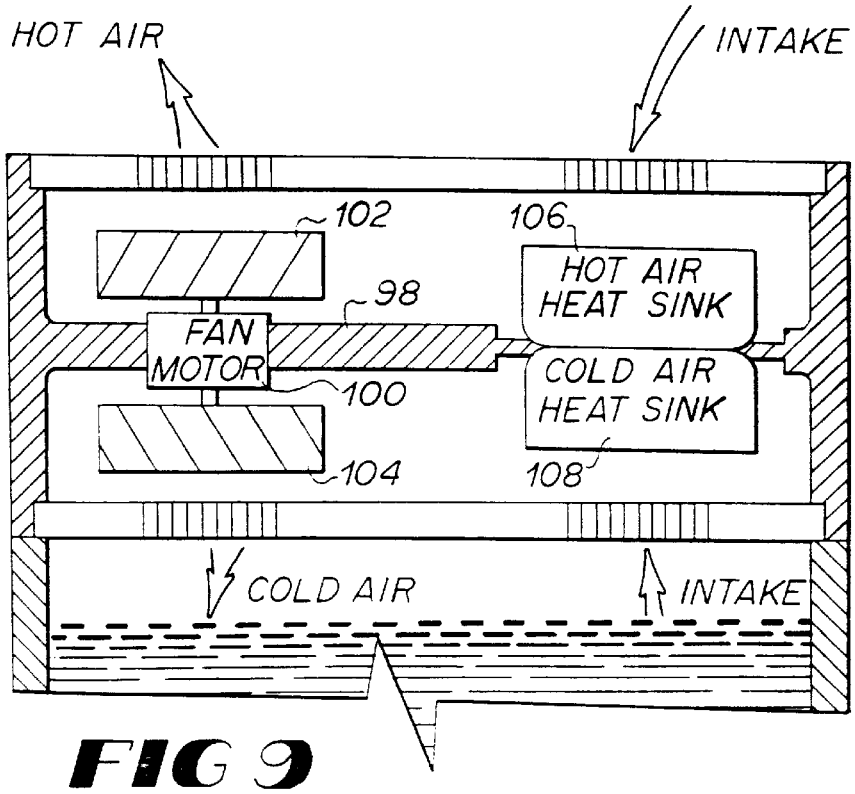
FIG. 9 is a cross-sectional side view through the cover of FIG. 8.

FIGS. 8 and 9 show another embodiment of this invention of a lid or cover 96 for the dispenser 10. The lid 96 has a thermoelectric cooling means for blowing cold air over the top of the water in the water tank. The lid 96 includes a wall 98. A fan motor 100, a hot air fan 102, a cold air fan 104, a hot air heat sink 106, and a cold air heat sink 108.

Figure 10:
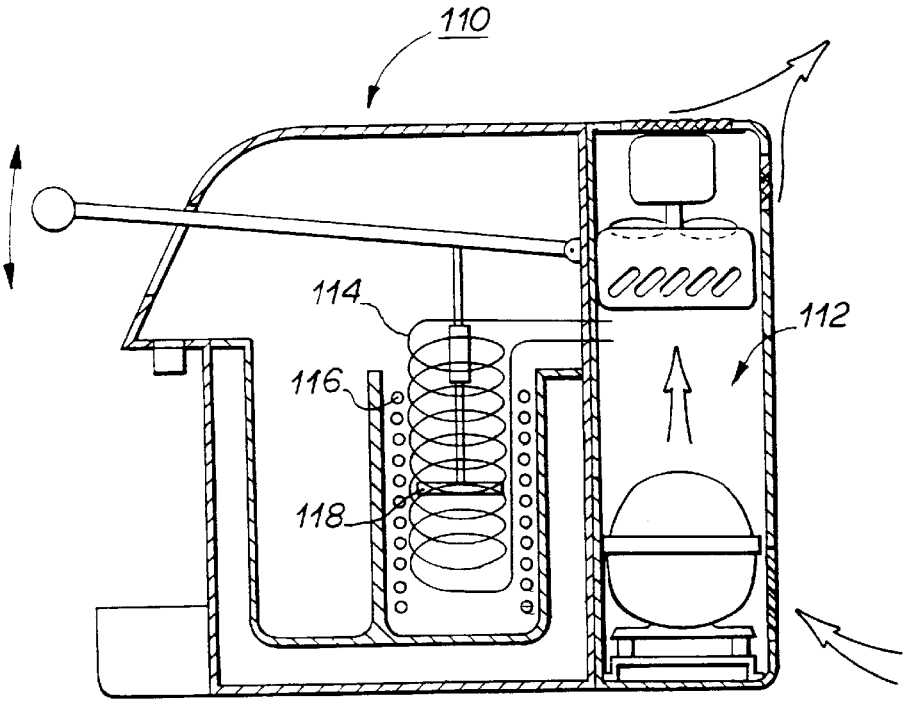
FIG. 10 is a cross-sectional side view through a dispenser similar to that of FIG. 1 but with vapor/compression refrigeration.

FIG. 10 shows another embodiment which can be used to upgrade the basic dispenser 10 of FIGS. 1–5. FIG. 10 shows a dispenser 110 similar to dispenser 10 except that it includes a vapor/compression refrigeration unit 112 with evaporator coils 114 and plumbed water cooling coils 116 in the water tank. A typical agitator can be used in the water tank, or a water agitating plate 118 connected to the pump arm 20 can be used to keep costs down.

Figure 11:
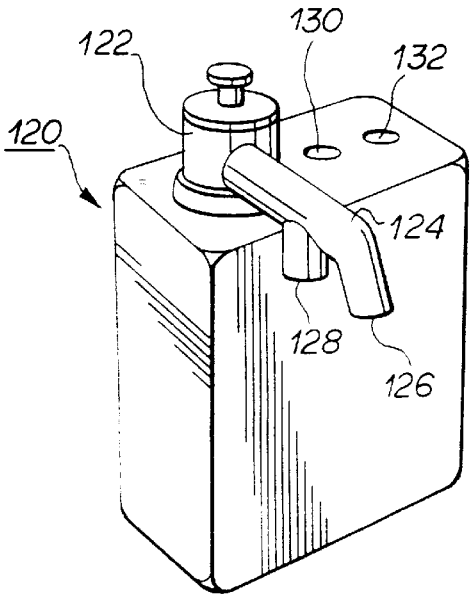
FIG. 11 is a perspective view of a concentrate package with a built-in pump and nozzle according to another embodiment of this invention.
Figure 12:
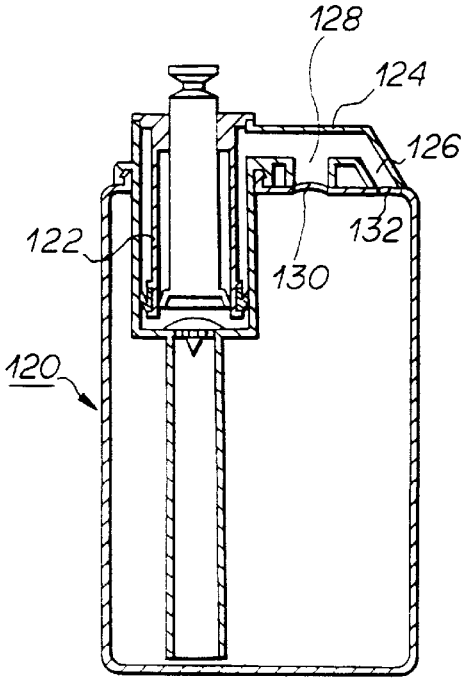
FIG. 12 is a cross-sectional side view through the package and pump of FIG. 11.

FIGS. 11 and 12 show a concentrate container 120 with a built-in pump 122 and a rotatable nozzle 124 having a beverage dispensing opening 126 and a water inlet opening 128. The nozzle nests for shipping with openings 126 and 128 retained on stops 130 and 132.

Figure 13:
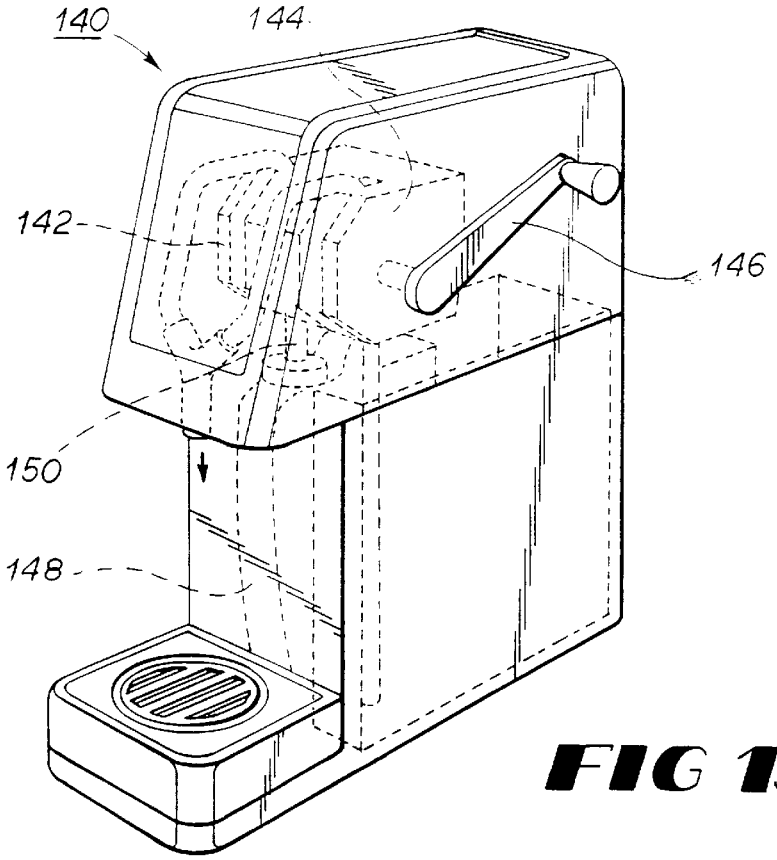
FIG. 13 is a partly broken-away perspective view of a dispenser according to another embodiment of this invention.

FIG. 13 shows a dispenser 140 similar to dispenser 10 except that dispenser 140 uses peristaltic pumps 142 and 144 in place of piston pumps 32 and 36, and uses a rotating pump handle 146 in place of reciprocating pump handle 18. The concentrate container 148 in this embodiment comes with a plastic tube 150 that is inserted into the peristaltic concentrate pump.

Figure 14:
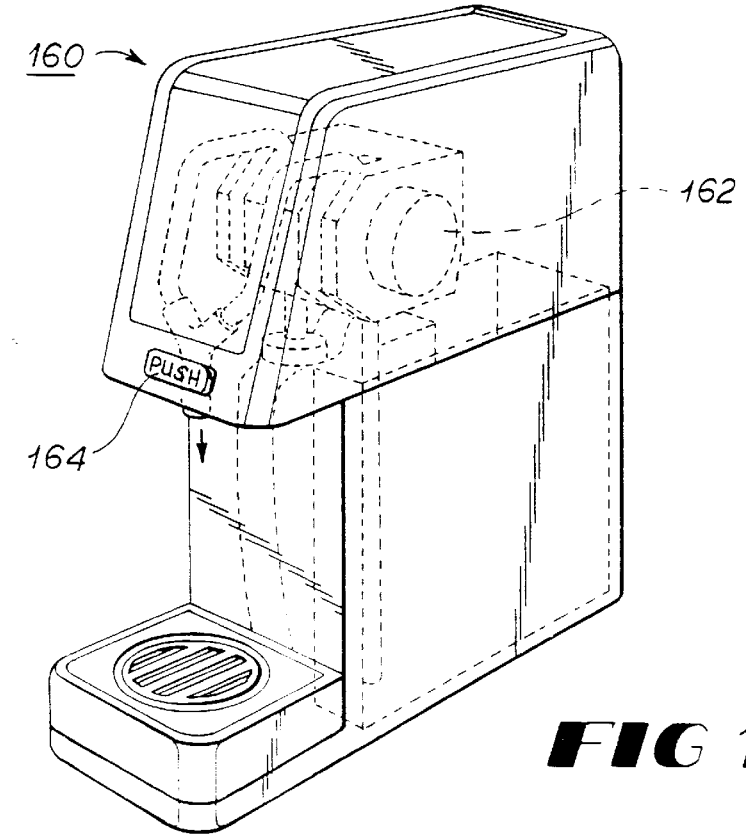
FIG. 14 is a view similar to FIG. 13 but showing a modification thereof using an electric motor in place of the manual pump handle.

FIG. 14 shows a dispenser 160 similar to dispenser 140 of FIG. 13 except that it uses an electric motor 162 in place of the manual handle 146 and a push button 164.

Figure 15:
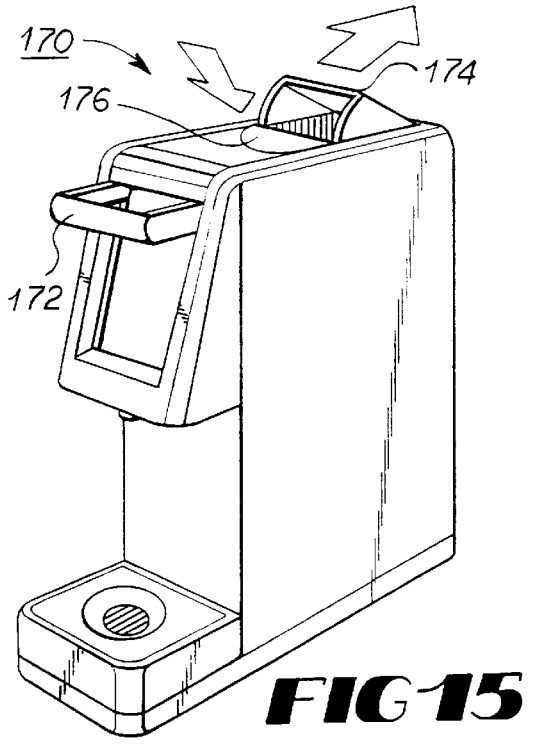
FIG. 15 is a perspective view of a dispenser according to another embodiment of this invention.

FIG. 15 shows a dispenser 170 having a U-shaped handle 172 and an ice and water refill access lid 174 that flips up to open. Water is poured into a depression 176 for ease of filling.

Figure 16:
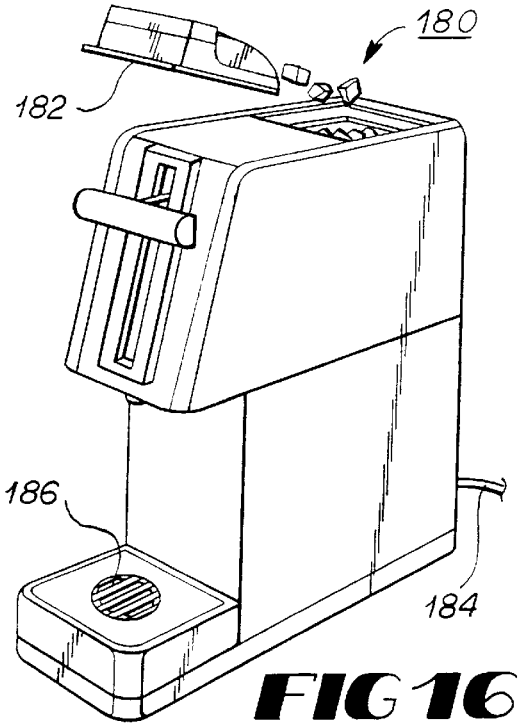
FIG. 16 is a perspective view of a dispenser according to yet another embodiment of this invention.

FIG. 16 shows a dispenser 180 having an ice refill access lid 182 that is removable for use as an ice scoop. The dispenser 180 is plumbed with water line 184 and has a float and valve for controlling the fill level.

Figure 17:
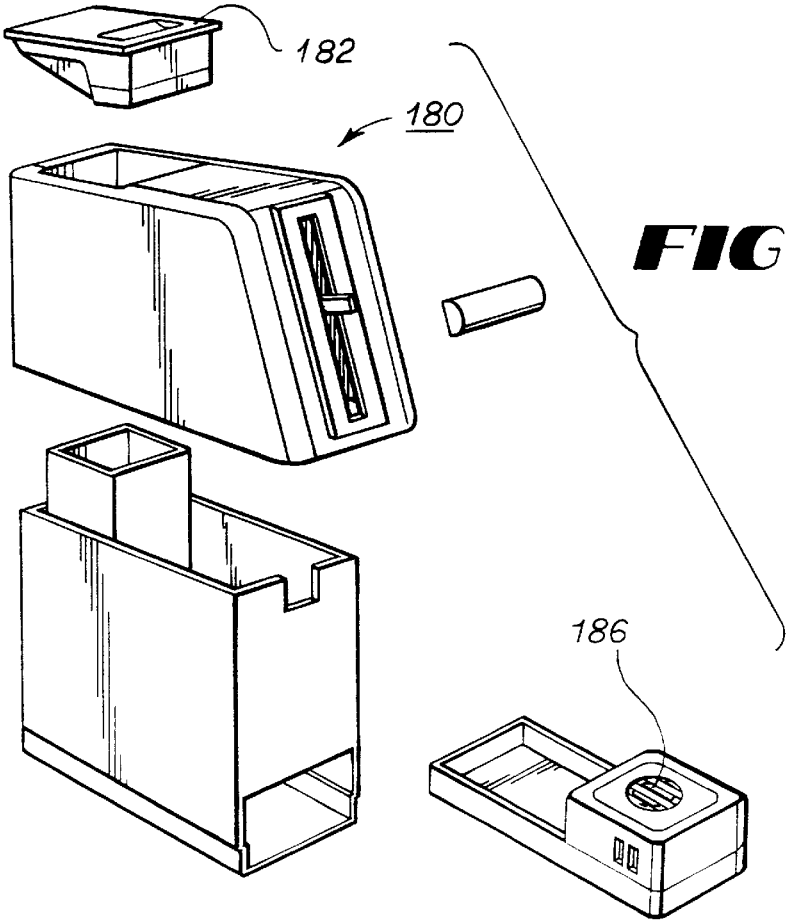
FIG. 17 is a partly exploded perspective view of the dispenser of FIG. 16 showing disassembly thereof for cleaning.
Figure 18:
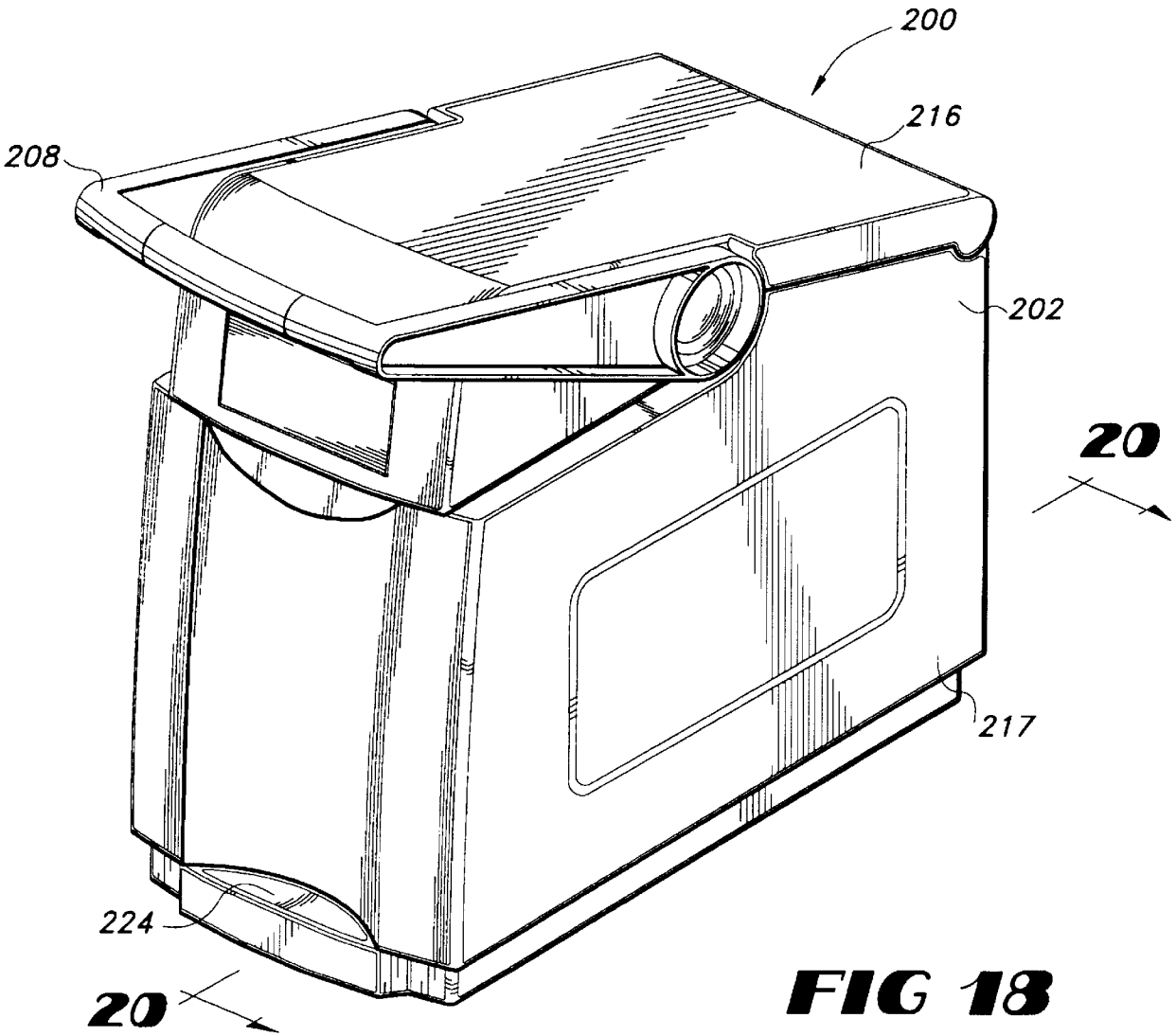
FIG. 18 is a top, front, right-side perspective view of the preferred embodiment of the dispenser of this invention.
Figure 19:
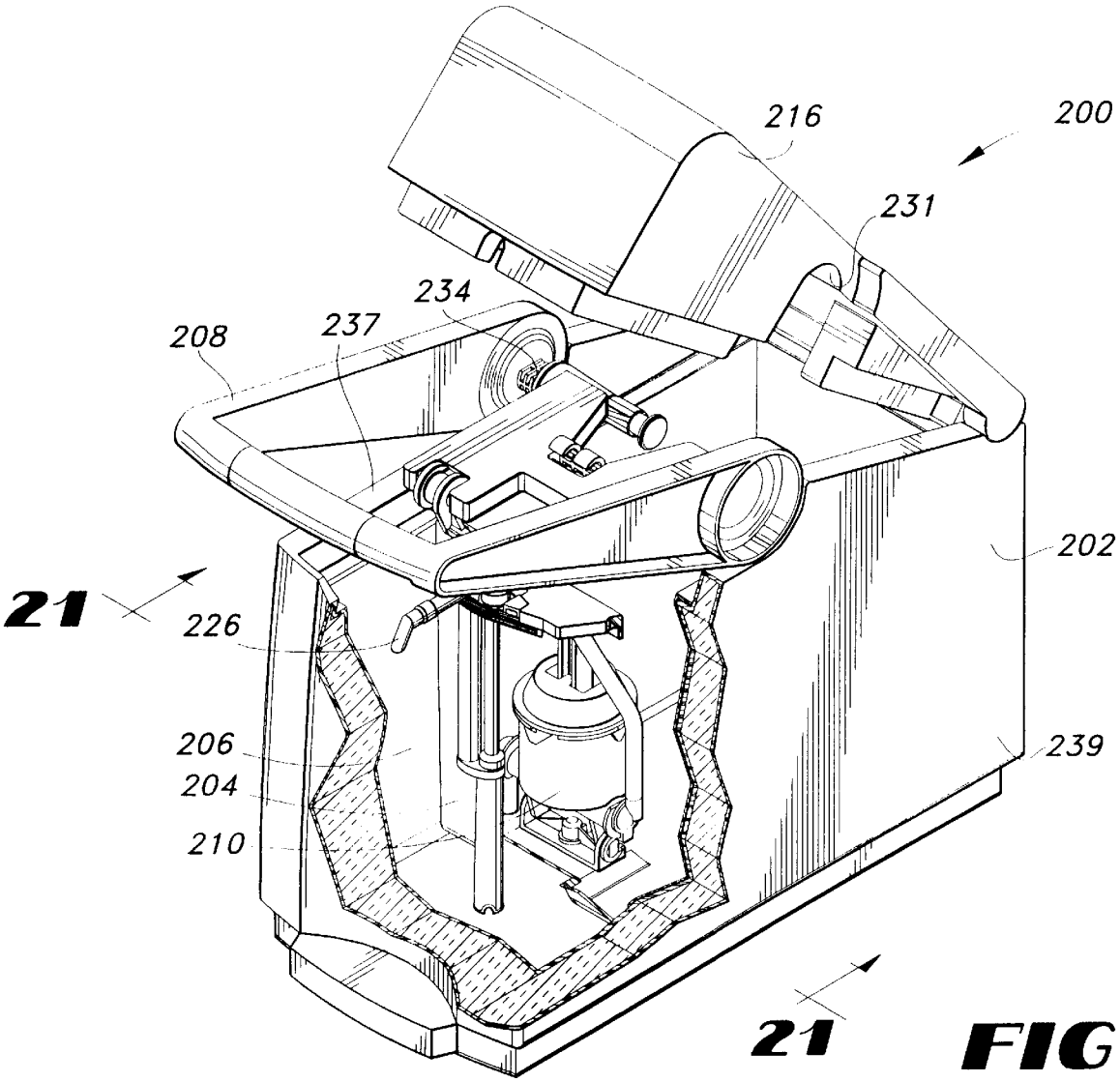
FIG. 19 is a partly broken-away perspective view of the dispenser of FIG. 18.

FIG. 17 shows the dispenser 180 with the parts thereof disassembled for cleaning. This disassembly feature is common to all of the different embodiments described herein. FIG. 17 shows the cup rest 186, the lid 182, the cover 188, the water tank 190, and the handle 192.

FIGS. 18–29 show the preferred embodiment of a dispenser 200 of the present invention. The dispenser 200 includes a housing 202 that includes a base 217 and a lid 216, a water tank 204, a concentrate package chamber 206 for receiving a disposable concentrate package 220, a pump handle 208, a water pump 210 in the water tank, connecting means 212 for connecting the pump handle to the water pump, and connecting means 214 for connecting the pump handle to a disposable concentrate pump 222 located in and part of the package 220. The removable lid 216 provides access to the water tank and concentrate package chamber. Retainer pins 218 and 219 hold the concentrate package pump 222 firmly in place against vertical movement thereof as the pump handle 208 is manually moved up and down during dispensing.

The housing 202 includes a drip tray 224 located beneath a beverage dispensing nozzle 226 which is part of the concentrate package 220. The pump handle extends through a pair of generally circular openings 230 and 231 in opposed sidewalls 237 and 239 of the housing 202. The handle 208 includes a proximal end 232 pivotably connected at 234 and 235 inside the housing and a distal end 228 located outside of and in front of the housing. The distal end is manually grasped and moved up and down to pump a beverage into a cup held below the nozzle 226.

The walls, including the lid and bottom wall, of the housing 202 are relatively thick to provide excellent thermal insulation to keep the ice and water in the tank 204 cold. The water tank 204 and the housing inner liner 203 are preferably injection molded of ABS. The housing outer shell 205 is preferably blow-molded of polyethylene. Foam is blown in-between the inner liner and the outer shell as is done in a well-known manner with coolers. The concentrate package chamber 206 is located between a front wall 236 of the water tank and the front wall 238 of the housing. A drain 240 with a drain plug is located in the bottom wall of the housing in the chamber 206.

Figure 20:
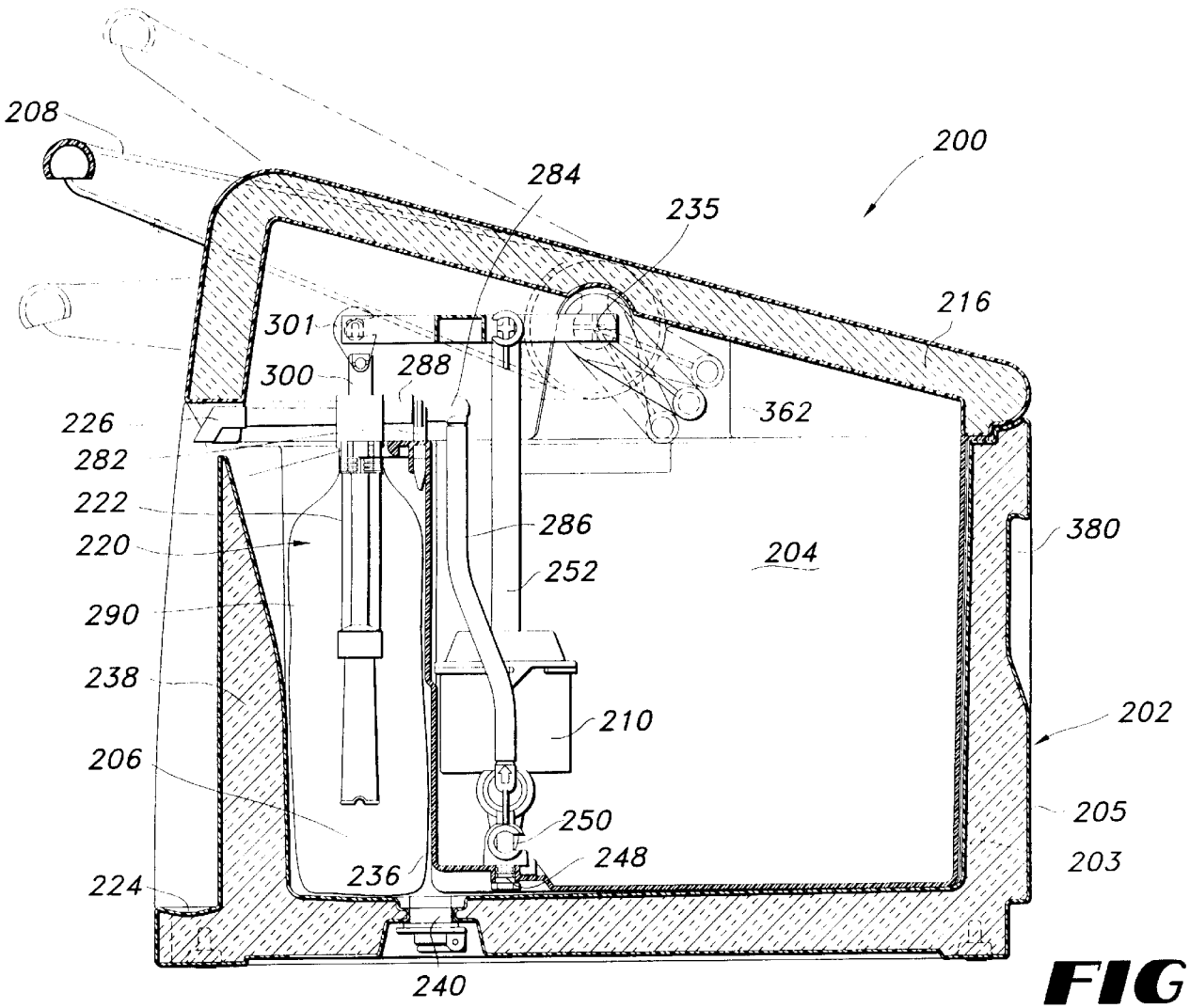
FIG. 20 is a partly cross-sectional right side view of the dispenser of FIG. 18 taken along line 20—20 of FIG. 18.
Figure 21:
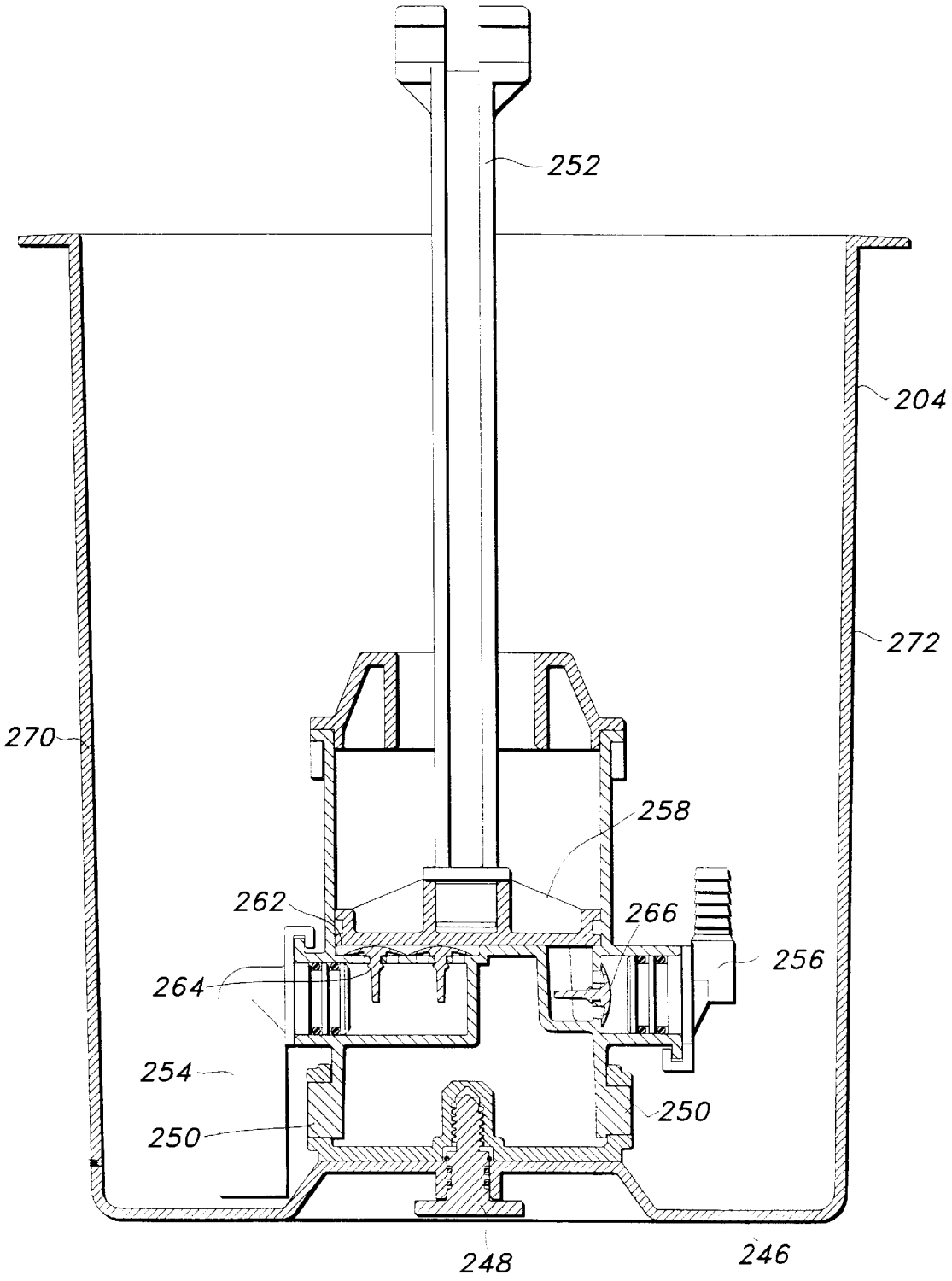
FIG. 21 is a cross-sectional, front view of the water tank and water pump of the dispenser taken along line 21—21 of FIG. 19.
Figure 22:
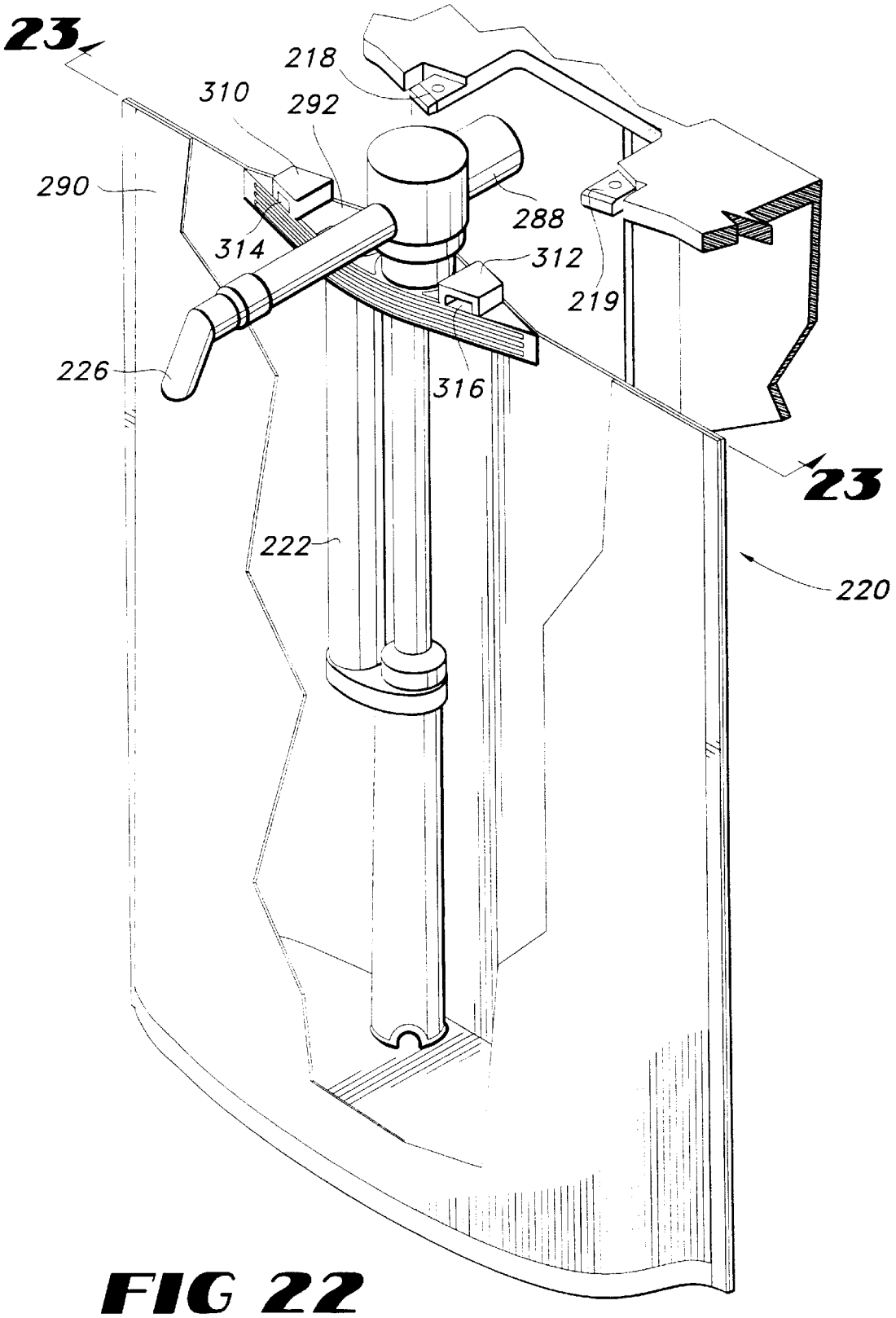
FIG. 22 is a partly broken-away perspective view of the preferred embodiment of the concentrate package for use in the dispenser of FIG. 18.

With reference to FIGS. 20 and 21, the water tank 204 is removably positioned in the housing. The water pump 210 is removably connected to the bottom wall 246 of the water tank by a captured bolt 248. The water pump is pivotably connected at 250 to allow the water pump to pivot forward and backward as the piston rod 252 reciprocates up and down. The water pump has an inlet 254, an outlet 256, a piston 258, the piston rod 252, a pumping chamber 262, inlet umbrella check valves 264 and an outlet umbrella check valve 266.

Figure 25:
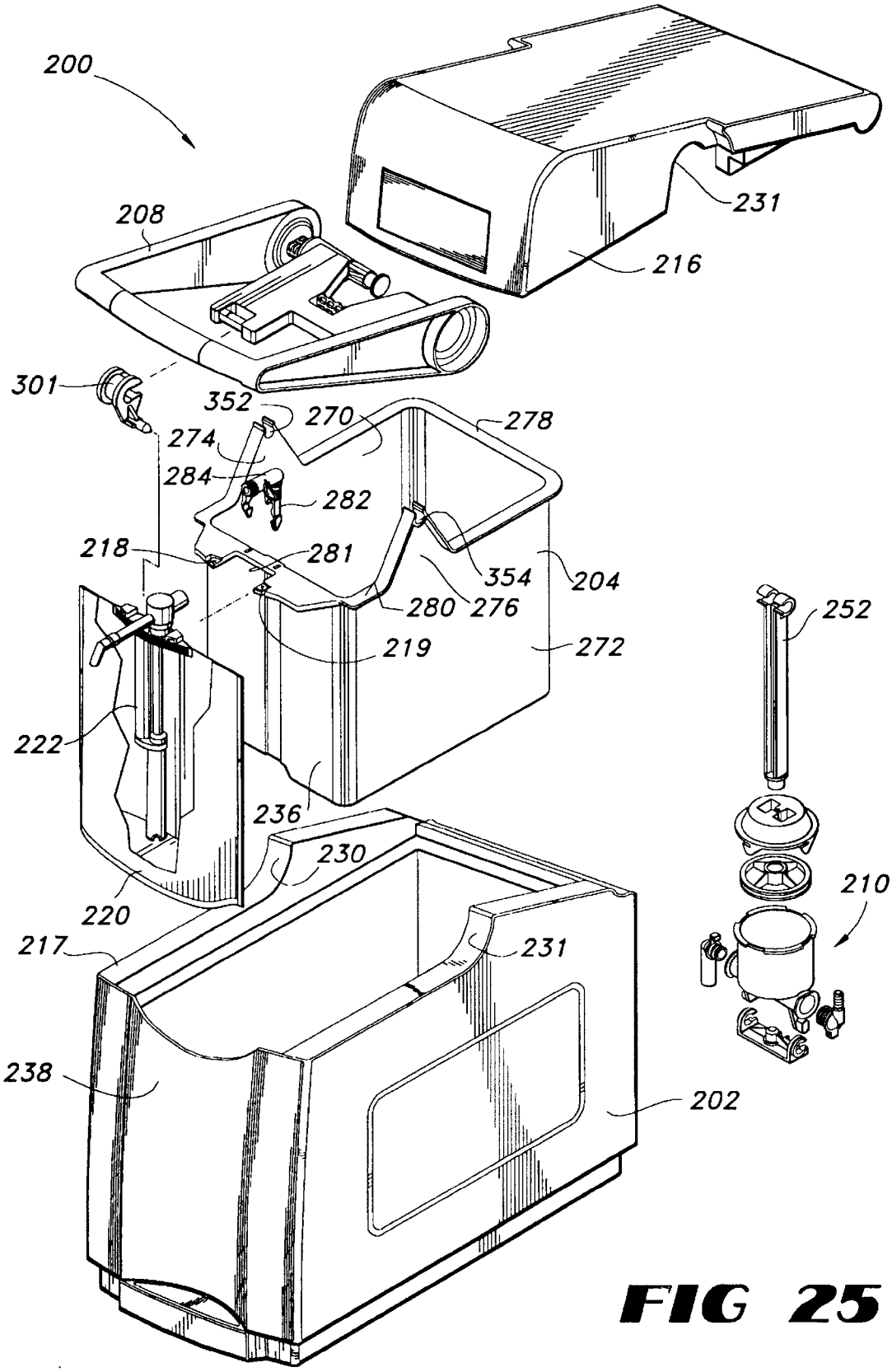
FIG. 25 is an exploded view of the dispenser of FIG. 18.

As shown in FIG. 25, the water tank has a flange 280 extending forward from the top edge 278 of the front wall 236. The flange has a U-shaped recess 281 to receive the concentrate package, as described in more detail below.

The water tank also has retaining clip 282 on the top edge 278 of the front wall 236 for holding a quick connect coupling 284 on the distal end of a water line 286 extending up from the outlet of the water pump 210. As described below in more detail, when a concentrate package is inserted into the chamber 206, a water inlet coupling 288 on the nozzle 226 matingly couples to the coupling 284.

As best seen in FIGS. 20 and 25, opposed side walls 270 and 272 of the water tank have vertically upstanding supports 274 and 276, respectively. The proximal end 232 of the pump handle 208 is pivoted at 234 and 235 with the handle shafts 324 and 326 being located in the pivot channels 352 and 354 in the top of the supports 274 and 276. The pump handle can be removed without tools by simply rotating it upwardly until the cut-out portion of the pivot shafts align with the access openings in the pivot channels 352 and 354 and allow the handle to be lifted out.

Figure 24:
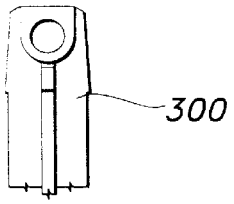
FIG. 24 is a partial side view showing the top of the concentrate piston rod.
Figure 27:
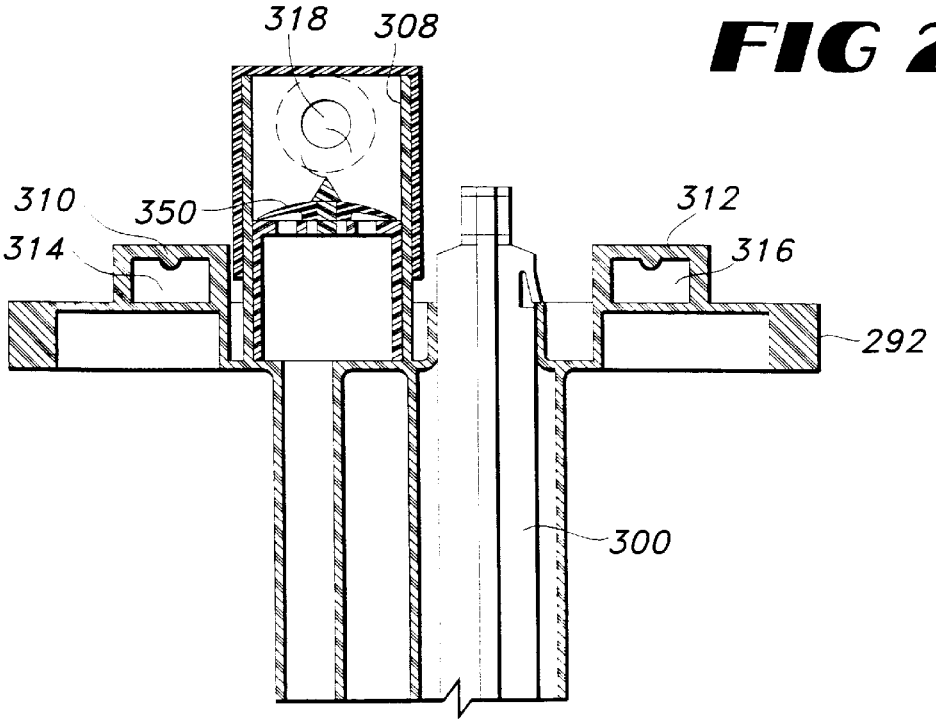

The pump handle has a cantilevered inner portion 342 with connection means 212 for connecting to the piston rod 252 of the water pump, and connection means 214 for connecting to the piston rod 278 of the concentrate pump 222. The connection means 212 operates as described above with reference to the handle pivots and also does not require the use of tools. The connection means 214 operates as shown in FIG. 24 and also does not require the use of tools.

Figure 28:
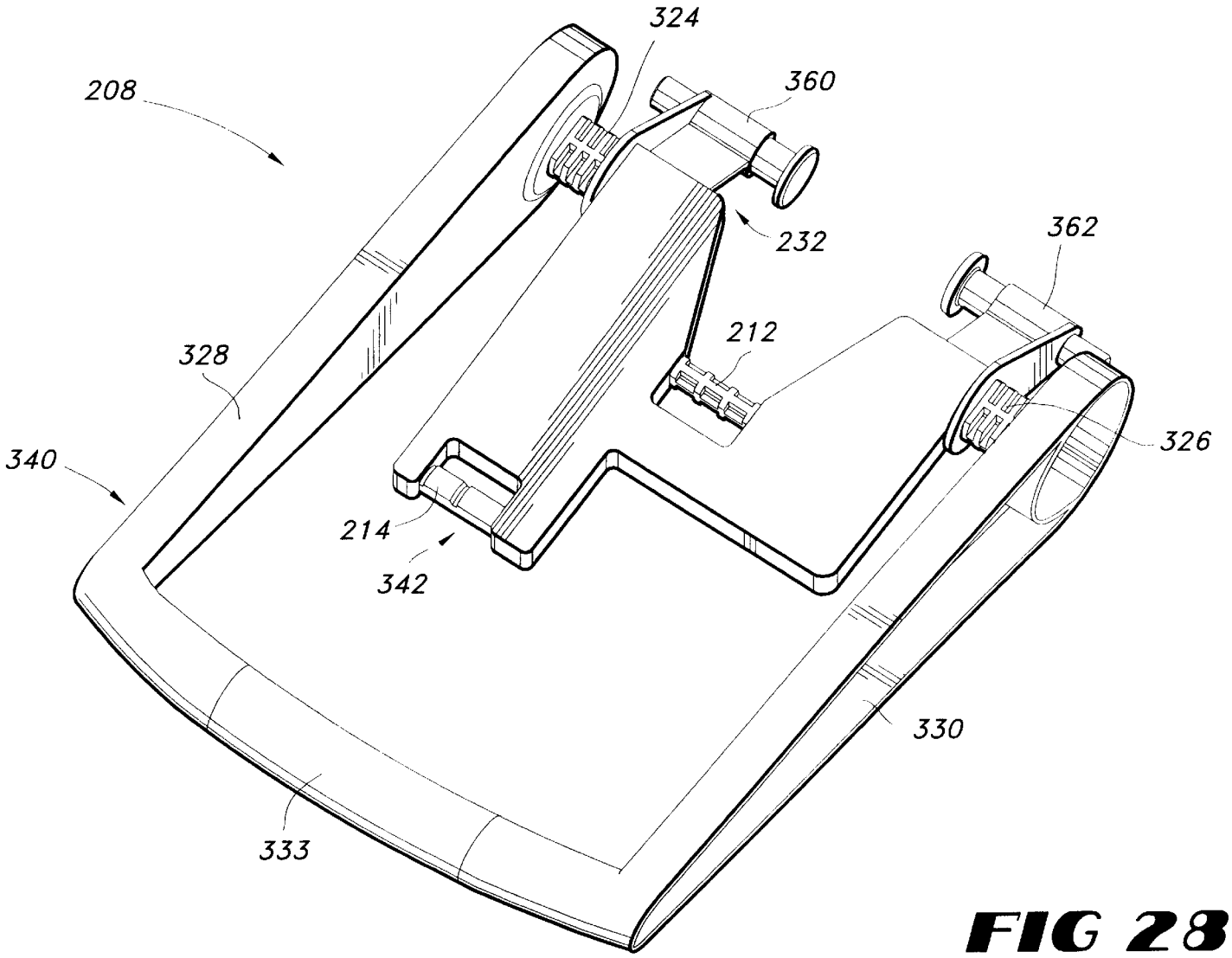
FIG. 28 is a top, front, right side perspective view of the preferred embodiment of the pump handle of this invention.
Figure 29:
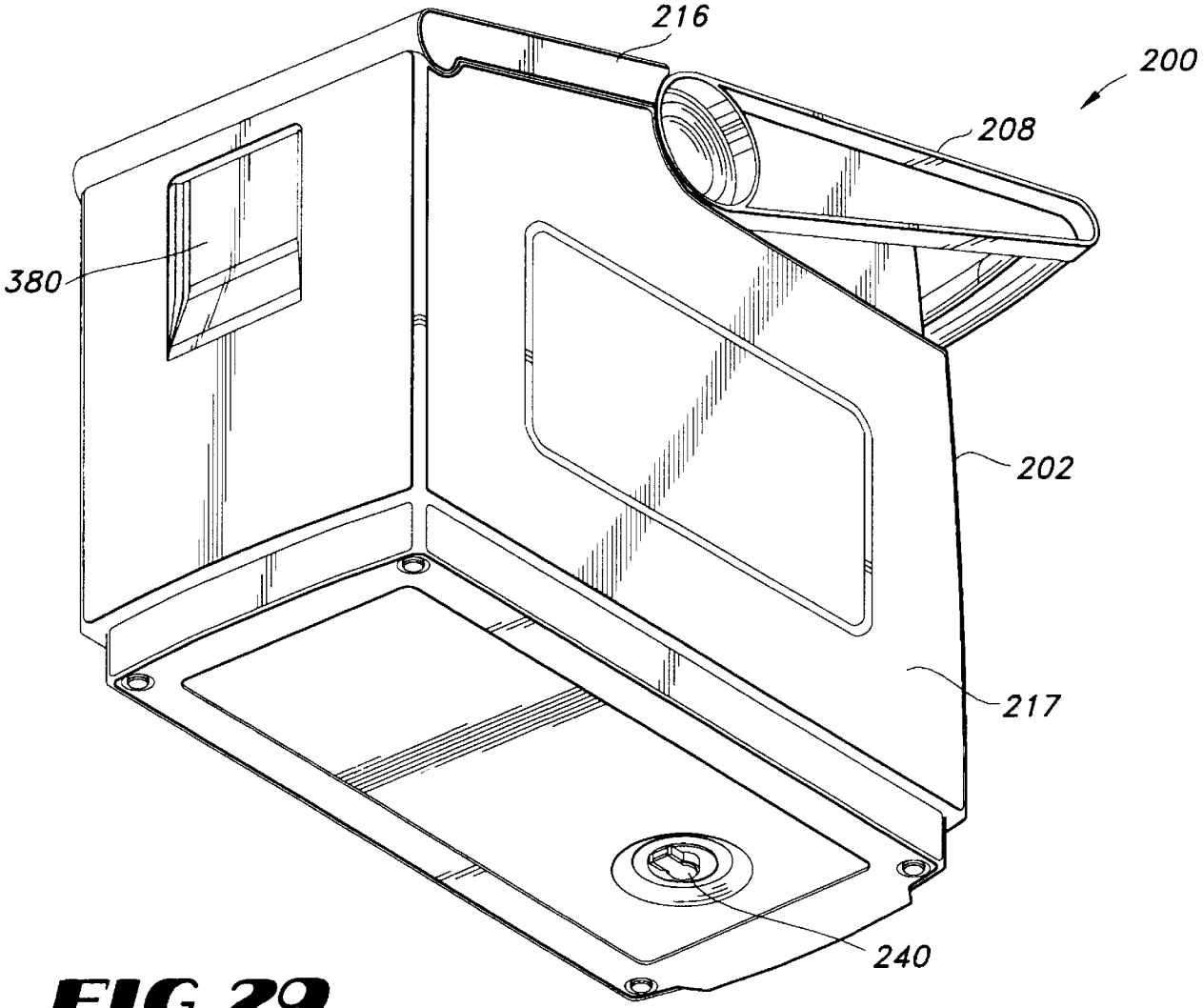
FIG. 29 is a rear, left side, bottom perspective view of the dispenser of FIG. 18.

The two shafts 324 and 326 of the pump handle 208 extend through the two generally circular openings 230 and 231 in opposite sidewalls of the housing. The handle includes an outer U-shaped portion 340 and an inner cantilevered pump actuating portion 342. The outer portion 340 includes two side bars 328 and 330 and a front cross piece 333. FIG. 28 is a perspective view of the handle 208 showing the side bars, the front cross piece 333 and the inner cantilevered pump actuating portion 342. The dispenser 200 eliminates the need for the slot in the dispenser of FIG. 1 for the pump handle. This improves performance by helping to prevent warm air from entering into the housing.

The concentrate package 220 will now be described primarily with reference to FIGS. 22–27. The package includes flexible pouch 290, the concentrate pump 222 and the nozzle 226. The pouch can be made of any appropriate flexible film material and can be made, filled and sealed in any one of a number of known methods. The concentrate pump and nozzle include a support (also known as a boat or canoe) 292 to which the pouch is sealed.

The concentrate pump 222 includes a pumping cylinder 294 enclosing a pumping chamber 296, a piston 298, a piston rod 300, inlet check valve 302, and outlet check valve 304. The distal end of the piston rod is connected to the pump handle connecting means 214 (see FIG. 24).

Figure 23:
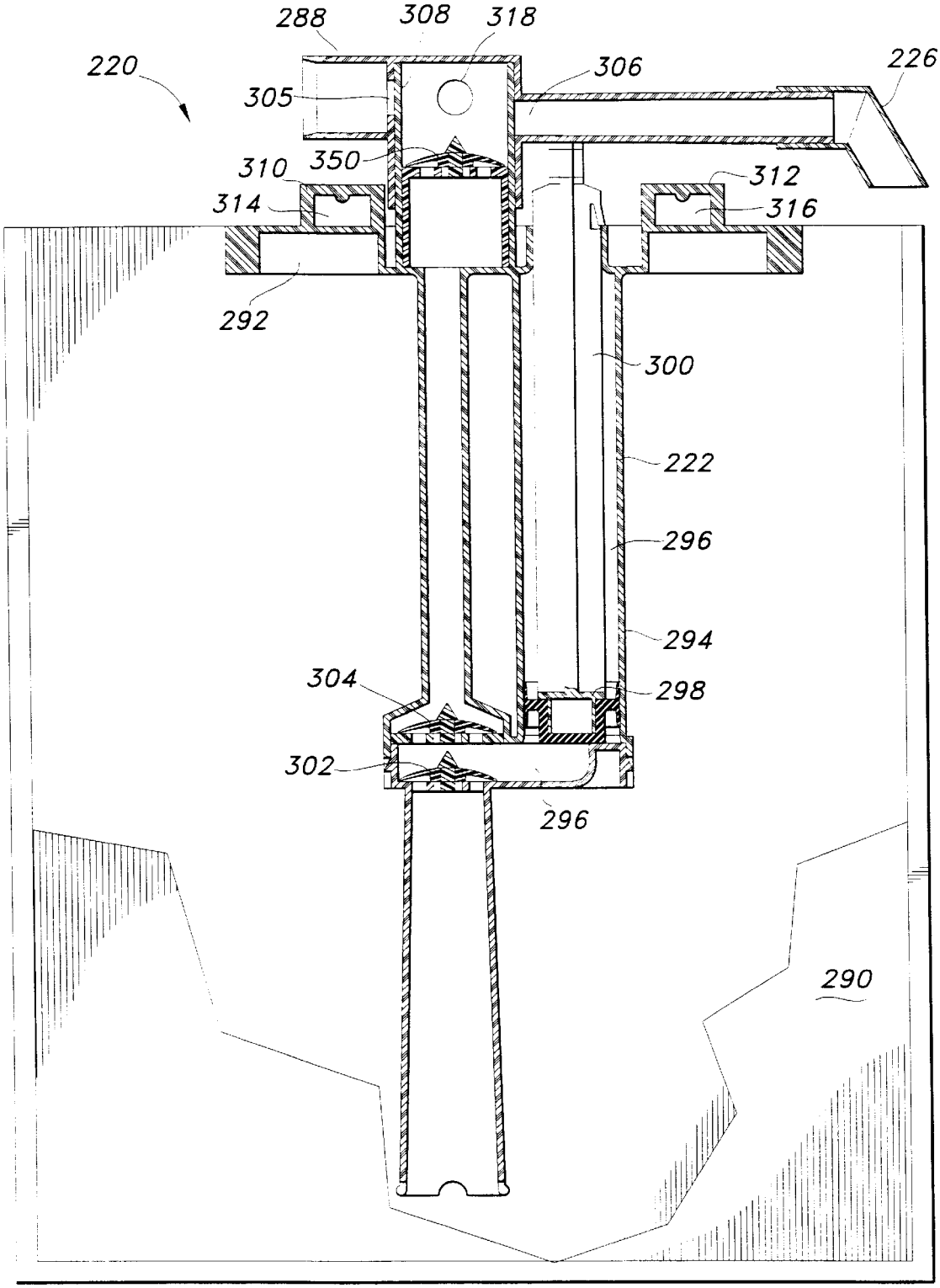
FIG. 23 is a partly cross-sectional view of the package of FIG. 22, taken along line 23—23 of FIG. 22 with the nozzle shown rotated to its shipping position.
Figure 26:
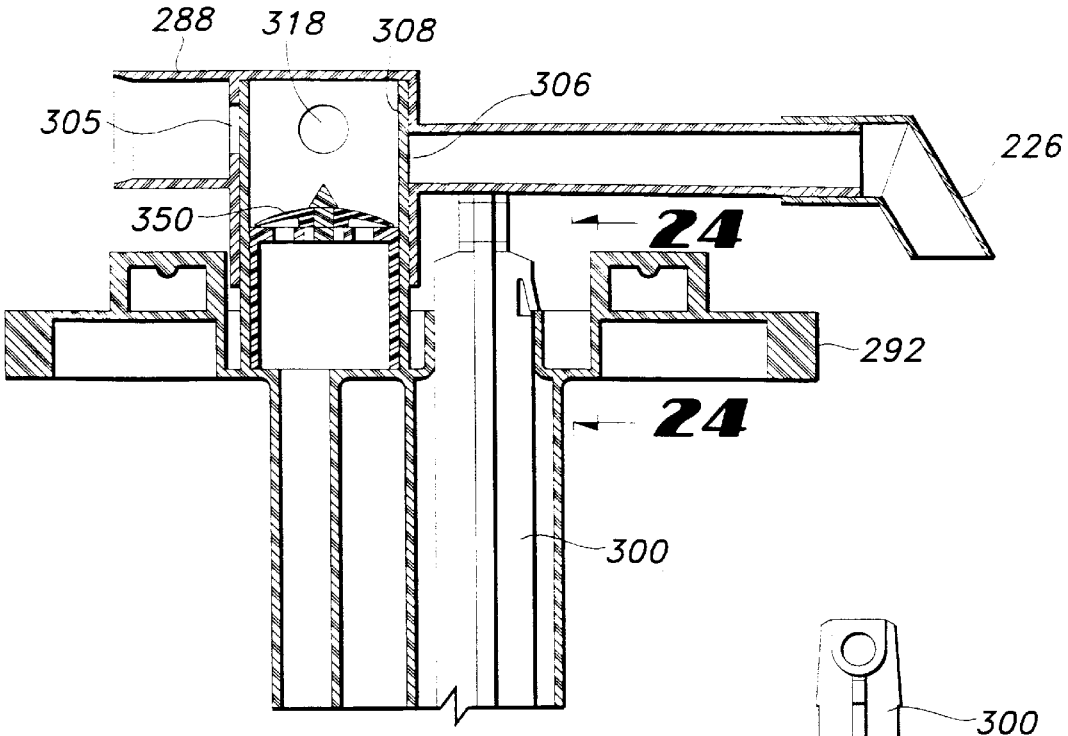
FIGS. 26 and 27 are cross-sectional views through the nozzle showing the concentrate flow valve in its closed and open positions, respectively.

The nozzle 226 is rotatably connected to the support 292 and is aligned with the plane of the pouch during shipping and is then rotated 90° prior to insertion into the chamber 206. The proximal end of the nozzle includes the coupling 288 which slides over the water line coupling 284 in sealing relationship thereto. The nozzle includes a pair of openings 305 and 306 and the nozzle support 308 includes a pair of opposed openings 318 (one of which is shown in FIG. 23). The openings in the nozzle support do not line up with the openings in the nozzle when the nozzle is in the plane of the pouch, thus preventing liquid from leaving the package during shipping. When the package is to be inserted into the dispenser, the nozzle is rotated 90°, to its dispense position, in which position the holes 305, 306 and the two holes 318 all line up and allow concentrate to flow out of the pouch during pumping. These holes and the rotation of the nozzle provides an on-off valve controlling flow out of the bag depending on the position of the nozzle. The nozzle 226 is preferably held onto the support 292 by the nozzle support 308 tapering to a larger O.D. in the upper direction. This interference fit will hold the nozzle onto the support.

The support 292 also includes a pair of tabs 310 and 312 forming channels 314 and 316, respectively. The package is inserted into the chamber 206 and the support 292 is pushed into the recess 281 until the retainer pins 218 and 219 are fully seated in respective ones of the channels 314 and 316, thus holding the package in place and against any vertical movement during pumping.

If it is desired to remove the package 220 because it is empty or to change products to be dispensed by the dispenser, the lid 216 is removed, the piston rod 300 is disconnected from the pump handle, the nozzle is rotated back to its shipping position, the package is pulled off of the retainer pins 218 and 219, thus also pulling the water coupling 288 off of the quick connect coupling 284, and the package is then lifted out of the dispenser.

The housing includes a recess 380 in the rear wall of the base 217, which can be used as a handhold along with the handle 208 when lifting the dispenser 200. Also, the handle 208 is provided with stops 360 and 362 which abut against the top of the base to prevent the lifting force from being applied to either of the pumps.

The concentrate pump 222 preferably includes the umbrella check valve 350 shown in FIG. 23, however, this valve is not essential. Also, as shown in FIG. 23, the channels 314 and 316 are preferably provided with a small protrusion that may mate with a corresponding recess in the retainer pins 218 and 219 when the concentrate package is fully inserted.

The lid 216 can alternatively be two separate lids, one for the concentrate package and one for the water and ice. The water pump is preferably located in the water tank, however, this is not essential. The nozzle is preferably disposable along with the package, however, it can alternatively be cleaned and reused and be a part of the dispenser rather than a part of the package. Instead of a disposable package, a dump tank can be used. The concentrate can alternatively also be a part of the dispenser rather than being disposable; it can be cleaned periodically and it does not have to be inside the concentrate container. The drip tray can have a drain hole if desired. The openings in the housing that accomodate the handle shafts can be sealed, if desired, with a suitable seal.

The pump handle preferably is as shown with two side bars, however, it can be made with only one side bar and only one shaft extending through a single opening in the housing. The inner portion 342 is preferably cantilevered, although this is not essential.

In addition to piston and peristaltic pumps, other pumps such as bellows and moyno pumps can alternatively be used. Also, they can be different types, for example, a moyno concentrate pump can be used with a peristaltic water pump. The pumps can be separate assemblies or an integral part, for example, of the concentrate package. The water pump can be removable if desired. When using peristaltic pumps, gearing can be used to make pumping easier and in the desired direction. An optional upgrade is to motorize any of the pumps. The concentrate package can be an existing package, a flexible package or a dump tank, for example. Cold plate cooling can be used in place of an open water-bath with ice. The dispenser can be provided with means to connect the water tank to an existing water supply. Several dispensers can be connected side by side to provide a plurality of available juices. If pre-chilled water is available, the dispenser can be made smaller.

While the preferred embodiment of this invention has been described above in detail, it is to be understood that variations and modifications can be made therein without departing from the spirit and scope of the present invention.

What is claimed is:

1. A low-cost, postmix, beverage dispenser comprising:

(a) a housing;

(b) a water tank located in said housing;

(c) said housing having a concentrate package chamber therein adjacent said water tank;

(d) a manually operable pump handle having a proximal end inside of said housing and extending out through said housing to a distal end thereof for manual movement thereof for pumping a beverage out of said dispenser, said handle including an inside portion inside said housing and an outside portion outside said housing;

(e) means for supporting said proximal end of said pump handle inside of said housing;

(f) a water pump located inside of said housing;

(g) said water pump being a volumetric pump;

(h) said water pump having an inlet port for receiving water from adjacent the bottom of said water tank and an outlet port for feeding water out of said water pump;

(i) means for connecting said pump handle to said water pump for driving said water pump when said pump handle is manually operated;

(j) said pump handle including means for connecting said pump handle to a concentrate pump;

(k) said dispenser including means for adding water to said water tank; and (l) said housing having a concentrate package access door for allowing the insertion into said chamber and the removal from said chamber of a concentrate package.

2. The dispenser as recited in claim 1 wherein said housing includes at least one substantially circular opening therethrough and said pump handle includes a rotatable shaft extending through said opening.

3. The dispenser as recited in claim 2 wherein said outside portion of said pump handle is adapted for up and down reciprocating movement and said water pump is a reciprocating piston pump.

4. The dispenser as recited in claim 3 wherein said housing includes a pair of said openings, one through each of opposed sidewalls thereof, and said pump handle includes a pair of said shafts, each one extending through a respective one of said openings, and said outside portion of said pump handle extends from said pair of shafts toward the front of said housing.

5. The dispenser as recited in claim 4 wherein said housing includes a front wall and wherein said outside portion of said pump handle includes a pair of side bars located outside of said housing and a front cross piece adjacent to but in front of said front wall of said housing connecting the distal ends of said side bars.

6. The dispenser as recited in claim 5 wherein said inside portion of said pump handle includes a shaft pivotally supported for arcuate movement in said pump handle supporting means and also includes a cantilevered portion connected to said water pump.

7. The dispenser as recited in claim 6 wherein said inside portion includes water pump piston connection means and separate concentrate pump piston connecting means.

8. The dispenser as recited in claim 3 including holding means inside of said housing adjacent said chamber for holding a concentrate pump against vertical movement when located in said chamber.

9. The dispenser as recited in claim 8 wherein said water pump is located inside of said water tank and includes a vertically extending, reciprocable piston rod connected at its distal end to said pump handle.

10. The dispenser as recited in claim 9 wherein said water pump is removably connected to a bottom wall of said water tank.

11. The dispenser as recited in claim 10 wherein said water pump is pivotably connected to said water tank for pivotal movement thereof as said piston rod reciprocates.

12. The dispenser as recited in claim 9 including a water outlet line connected at its proximal end to said water outlet port and at its distal end to a retainer means located on a top edge of a front wall of said water tank.

13. The dispenser as recited in claim 9 wherein said water tank includes an upper edge and includes a pair of vertically upstanding supports on opposite sidewalls thereof and extending above said upper edge, and means for pivotably connecting said proximal end of said pump handle adjacent the top end of said supports.

14. The dispenser as recited in claim 8 wherein said holding means includes retaining means on a top edge of a front wall of said water tank.

15. The dispenser as recited in claim 8 wherein said chamber is located between a front wall of said water tank and a front wall of said housing.

16. The dispenser as recited in claim 8 wherein said housing includes a removable top cover, said cover being said water adding means and also said access door.

17. The dispenser as recited in claim 3 including a disposable concentrate package located in said chamber.

18. The dispenser as recited in claim 17 including a disposable concentrate pump located inside of said package and having a reciprocable piston rod extending exteriorly of said package.

19. The dispenser as recited in claim 18 wherein said package includes a beverage dispensing nozzle extending exteriorly of said housing.

20. The dispenser as recited in claim 18 including holding means inside of said housing adjacent said chamber for holding said concentrate pump against vertical movement during pumping.

21. The dispenser as recited in claim 20 wherein said package holding means includes retainer means on a top edge of a front wall of said water tank, and said concentrate pump includes a retainer element that mates with said retainer means to hold said concentrate pump against vertical movement during pumping.

22. A disposable beverage concentrate package for use in a beverage dispenser comprising:

(a) a flexible bag concentrate container having and opening;

(b) a fitment attached to said container at said opening;

(c) a reciprocal pump attached to said fitment and extending therefrom down into said container and having a piston rod extending up away from said fitment exteriorly of said container;

(d) said pump including a pumping chamber, an inlet port into said chamber and in liquid communication with the interior of said container and a one-way valve in said inlet port allowing flow into said chamber, an outlet port from said chamber and a one-way valve in said outlet port allowing flow out of said chamber, a reciprocatable piston in said chamber and said piston rod being connected to said piston;

(e) said fitment including holding means thereon for connection to a package holder;

(f) a dispensing nozzle connected to said fitment and extending exteriorly of said bag, said nozzle having a liquid passageway therethrough, and said outlet port being in liquid communication with said passageway; and (g) wherein said nozzle includes a water inlet port wherein water can be fed into said passageway.

23. The package is recited in claim 22 wherein said nozzle is rotatably connected to said fitment whereby said nozzle has a shipping position wherein it overlies said bag during shipment and whereby it can be turned to a dispense position in which it does not overlie said bag.

24. The package as recited in claim 23 wherein said nozzle includes a valve that controls liquid communication between said bag and said passageway, said valve being closed when said nozzle is in its shipping position and said valve being open when said nozzle is rotated to its dispense position.

25. A disposable beverage concentrate package for use in a beverage dispenser comprising:

(a) a concentrate container having and opening;

(b) a fitment attached to said container at said opening;

(c) a reciprocal pump attached to said fitment and extending therefrom down into said container and having a piston rod extending up away from said fitment exteriorly of said container;

(d) said pump including a pumping chamber, an inlet port into said chamber and in liquid communication with the interior of said container and a one-way valve in said inlet port allowing flow into said chamber an outlet port from said chamber and a one-way valve in said outlet port allowing flow out of said chamber, a reciprocatable piston in said chamber and said piston rod being connected to said piston;

(e) said fitment including holding means thereon for connection to a package holder; and (f) wherein said fitment includes a canoe-shaped body sealed in a top edge of said bag, and said holding means includes a pair of spaced-apart tabs on a top surface of said body.

26. A disposable beverage concentrate package for use in a beverage dispenser comprising:

(a) a flexible bag concentrate container having and opening;

(b) a fitment attached to said container at said opening;

(c) a reciprocal pump attached to said fitment and extending therefrom down into said container and having a piston rod extending up away from said fitment exteriorly of said container;

(d) said pump including a pumping chamber an inlet port into said chamber and in liquid communication with the interior of said container and a one-way valve in said inlet port allowing flow into said chamber, an outlet port from said chamber and a one-way valve in said outlet port allowing flow out of said chamber, a reciprocatable piston in said chamber and said piston rod being connected to said piston;

(e) said fitment including holding means thereon for connection to a package holder; and (f) including a beverage dispensing nozzle connected to said fitment exteriorly of said bag, said nozzle including a concentrate inlet, a water inlet, and a beverage outlet.

27. The package as recited in claim 26 wherein said nozzle includes a manually operable shut-off valve movable back and forth between a first position closing said concentrate inlet and opening said water inlet and a second position opening both said concentrate inlet and said water inlet.

28. The-package as recited in claim 27 wherein said pump includes a pair of elongated hollow cylinders extending downwardly from said fitment into said bag, said pair including a first, larger diameter cylinder enclosing said pumping chamber, and a second, smaller diameter cylinder enclosing a concentrate outlet passageway.

29. The package as recited in claim 28 wherein said fitment includes a canoe-shaped body sealed in a top edge of said bag, and said holding means includes a pair of spaced-apart tabs on a top surface of said body.

* * * * *